US011905567B1

(12) United States Patent
Aamir et al.

(10) Patent No.: US 11,905,567 B1
(45) Date of Patent: Feb. 20, 2024

(54) HIGH PRESSURE, HIGH TEMPERATURE SPRAY COOLING SYSTEM

(71) Applicant: King Faisal University, Al-Ahsa (SA)

(72) Inventors: Muhammad Aamir, Al-Ahsa (SA); Muhammad Sajid, Al-Ahsa (SA); Muhammad Zubair, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/127,424

(22) Filed: Mar. 28, 2023

(51) Int. Cl.
*C21D 1/667* (2006.01)
*B22F 1/054* (2022.01)
*C21D 11/00* (2006.01)

(52) U.S. Cl.
CPC ..... *C21D 1/667* (2013.01); *B22F 1/054* (2022.01); *C21D 11/005* (2013.01); *B22F 2301/052* (2013.01); *B22F 2301/10* (2013.01)

(58) Field of Classification Search
None
See application file for complete search history.

(56) References Cited

U.S. PATENT DOCUMENTS

| | | | |
|---|---|---|---|
| 2004/0017185 | A1 | 1/2004 | Song et al. |
| 2008/0095652 | A1 | 4/2008 | Jiang |
| 2021/0387248 | A1 | 12/2021 | Takaya et al. |
| 2022/0169936 | A1 | 6/2022 | Mennell et al. |
| 2022/0340994 | A1 | 10/2022 | Wu et al. |

FOREIGN PATENT DOCUMENTS

| | | | | |
|---|---|---|---|---|
| CN | 108002697 A | | 5/2018 | |
| CN | 108277333 A | * | 7/2018 | ..... C21D 1/667 |
| WO | WO-2017109528 A1 | * | 6/2017 | ..... B22D 11/1245 |

OTHER PUBLICATIONS

Rybicki et al., "Single-phase and two-phase cooling characteristics of upward-facing and downward-facing spray," International Journal of Heat and Mass Transfer 49 (2006) 5-16.
Nayak et al., "Influence of spray characteristics on heat flux in dual phase spray impingement cooling of hot surface," Alexandria Engineering Journal, vol. 55, Issue 3, Sep. 2016, pp. 1995-2004.
Issa, "Multiphase Spray Cooling Technology in Industry," Advanced Technologies, Oct. 2009.
She et al., "Liquid-Nitrogen Spray-Cooling Combined Effect of the Spray Height and Heat-Sink-Surface Diameter," Appl. Sci. 2022, 12, 6941.

* cited by examiner

*Primary Examiner* — Scott R Kastler
(74) *Attorney, Agent, or Firm* — Nath, Goldberg & Meyer; Richard C. Litman

(57) ABSTRACT

A high pressure, high temperature spray cooling system for heat transfer. The system includes: a supply tank having a heater and a high pressure pump; and a spray chamber spaced apart from the supply tank. The spray chamber has a workpiece receiving bed and a nozzle spaced apart from the workpiece receiving bed. The supply line has a first supply line end and a second supply line end. The first supply line end is connected to the supply tank and the second supply line end is connected to the nozzle so that the contents within the supply tank are supplied to the nozzle through the supply line at a high pressure to cool a workpiece on the workpiece receiving bed.

14 Claims, 3 Drawing Sheets

HIGH PRESSURE, HIGH TEMPERATURE SPRAY COOLING SYSTEM

BACKGROUND

1. Field

The present disclosure relates to spray cooling for heat transfer, and particularly to a system and method for high pressure, high temperature, ultra-fast spray cooling for heat transfer.

2. Description of the Related Art

Spray cooling is a technology where a liquid is dispersed into droplets onto an object to cool. The object could be a piece of steel that is cooled during a manufacturing process. Gas atomization cooling is a type of spray cooling, and is done at a temperature below 100° C. A cooling rate of 20-100° C./s can be achieved with gas atomization, which is in the range of traditional laminar quenching rates.

Laminar quenching rates are slow. There is a need for a type of spray cooling that can achieve higher cooling rates in the ultra-fast cooling range (e.g. 558.71° C./s, 289.11° C./s, 160.02° C./s, 156.95° C./s).

SUMMARY

High pressure, high temperature spray cooling for heat transfer that achieves ultra-fast cooling rates is disclosed herein. Multi-phase spray cooling (solid, liquid, gas) at high temperatures (600° C. to 1,000° C.) and high pressure of up to 2.5 MPa provides ultra-fast cooling rates.

A high pressure, high temperature spray cooling system for heat transfer, in one embodiment, includes: a supply tank having a heater and a high pressure pump; and a spray chamber spaced apart from the supply tank. The spray chamber has a workpiece receiving bed and a nozzle spaced apart from the workpiece receiving bed. A supply line has a first supply line end and a second supply line end. The first supply line end is connected to the supply tank and the second supply line end is connected to the nozzle so that the contents within the supply tank are supplied to the nozzle through the supply line at a high pressure to cool a workpiece on the workpiece receiving bed.

The supply line further includes a control valve and a bypass valve to adjust the pressure of the contents in the supply line.

A mass flow meter is located between the first supply line end and the second supply line end.

The system further includes a gas supply tank, a gas line having a first gas line end connected to the gas supply tank and a second gas line end connected to the nozzle.

A gas regulating valve is further included to adjust the pressure of the gas supply in the gas line.

A gas flow meter is located between the first gas supply end and the second gas supply end.

The gas supply tank contains nitrogen gas.

The supply tank contains a liquid and nano-particles.

The liquid is water and the nano-particles are copper nano-particles (CuNPs) or aluminum nano-particles (AlNPs).

The system further includes a controller that acquires temperature data and pressure data in the system and adjusts the system to specific temperatures and pressures.

The high pressure pump reaches pressures of up to 2.5 MPa.

A high pressure, high temperature spray cooling method for heat transfer includes: receiving a workpiece in a spray chamber having a workpiece receiving bed and a nozzle spaced apart from the workpiece receiving bed; regulating the temperature of a supply tank to a set temperature, the supply tank having a heater and high pressure pump and being connected to the nozzle by a supply line; and supplying a high pressure cooling spray through the nozzle in the spray chamber from the supply tank.

The method further includes adjusting the pressure in the supply line using a control valve and a bypass valve.

The method further includes supplying a gas to the nozzle from a gas supply tank having a first gas line end connected to the gas supply tank and a second gas line end connected to the nozzle.

The method further includes adjusting the pressure in the gas line using a gas regulating valve.

The gas being supplied is nitrogen gas.

The high pressure cooling spray includes water and nano-particles.

The nano-particles are copper nano-particles (CuNPs) or aluminum nano-particles (AlNPs).

The method further includes applying a pressure of up to 2.5 MPa into the supply line.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Ultra-fast cooling can be achieved using a high pressure, high temperature spray cooling system for heat transfer.

Figure 1:
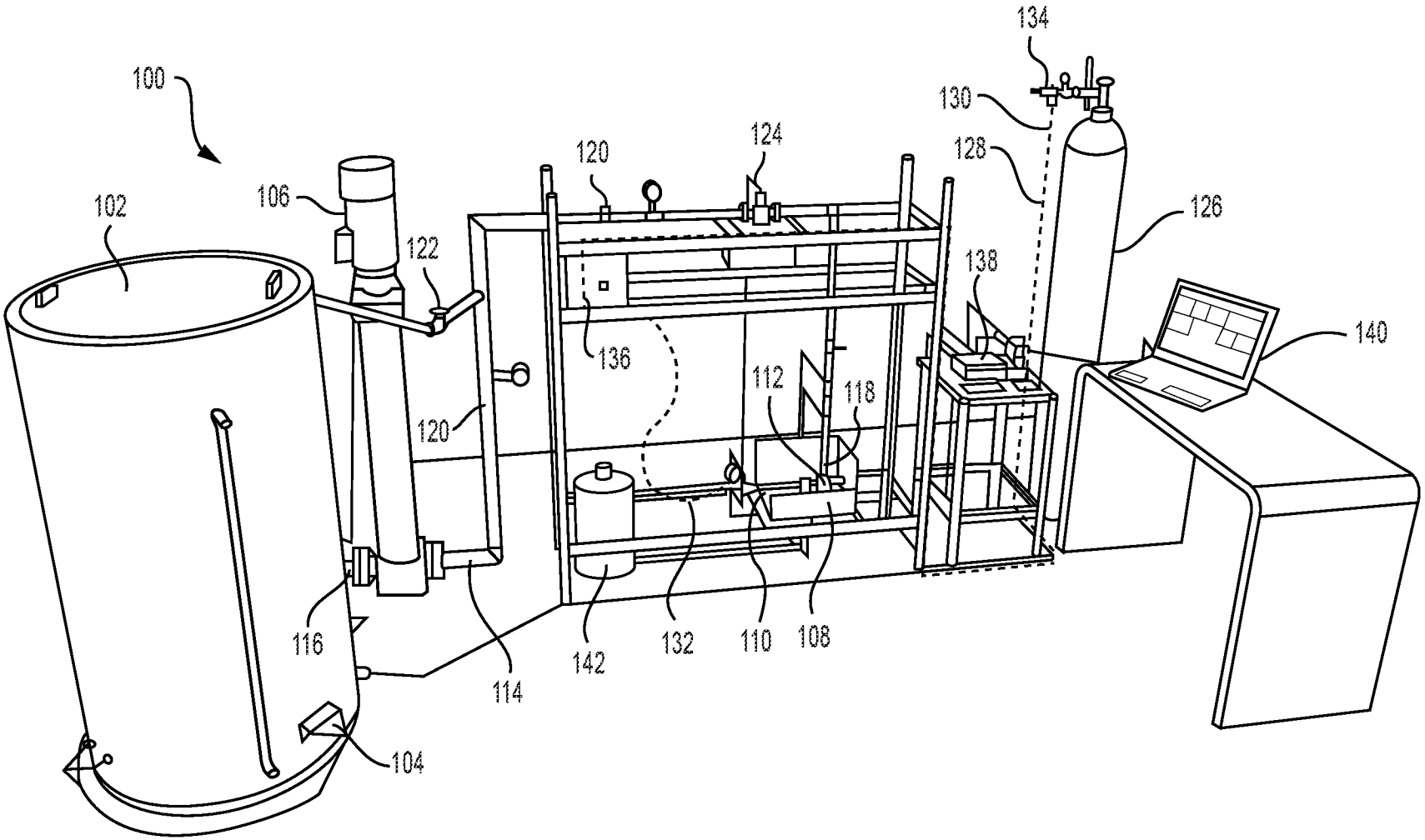
FIG. 1 is an illustration of a spray cooling system.

FIG. 1 is an illustration of a spray cooling system 100 that includes a supply tank 102 having a heater 104 and a high pressure pump 106. A spray chamber 108 is spaced apart from the supply tank 102. The spray chamber 108 has a workpiece receiving bed 110 and a nozzle 112 spaced apart from the workpiece receiving bed 110. A supply line 114 has a first supply line end 116 and a second supply line end 118. The first supply line end 116 is connected to the supply tank 102 and the second supply line end 118 is connected to the nozzle 112 so that the contents within the supply tank 102 are supplied to the nozzle 112 through the supply line 114 at a high pressure to cool a workpiece on the workpiece receiving bed 110.

The supply line 114 further includes control valves 120 and a bypass valve 122 to adjust the pressure of the contents in the supply line 114.

A mass flow meter 124 is located between the first supply line end 116 and the second supply line end 118.

The spray cooling system 100 further includes a gas supply tank 126, a gas line 128 having a first gas line end 130 connected to the gas supply tank 126 and a second gas line end 132 connected to the nozzle 112.

A gas regulating valve 134 is further included to adjust the pressure of the gas supply in the gas line 128.

A gas flow meter 136 is located between the first gas supply end 130 and the second gas supply end 132.

In some embodiments, the gas supply tank 126 contains nitrogen gas, and the supply tank 102 contains a liquid and nano-particles. The liquid can be water and the nano-particles can be copper nano-particles (CuNPs) or aluminum nano-particles (AlNPs). In certain embodiments, the nano-particles can be mixed in the liquid to form a homogenous suspension.

In other embodiments, a separate liquid, for example, water, and pump system can be added to the spray cooling system to introduce a liquid/nano-particle fluid into the nozzle 112. According to these other embodiments, use of a separate storage tank and pump would be particularly beneficial if the quantity of liquid to be sprayed and flow rates are small to economize power and nano-particles. In such a modified spray cooling system, storage tanks and pumps could potentially work on an alternative basis according to various requirements.

The spray cooling system further includes a controller made up of a data logger 138 and computer 140 that acquires temperature data and pressure data in the system and adjusts the system to specific temperatures and pressures.

The high pressure pump 120 can reach pressures of up to 2.5 MPa.

A gas cylinder 142 is connected under the workpiece receiving bed 110 and can supply gas to heat a workpiece.

Figure 2:
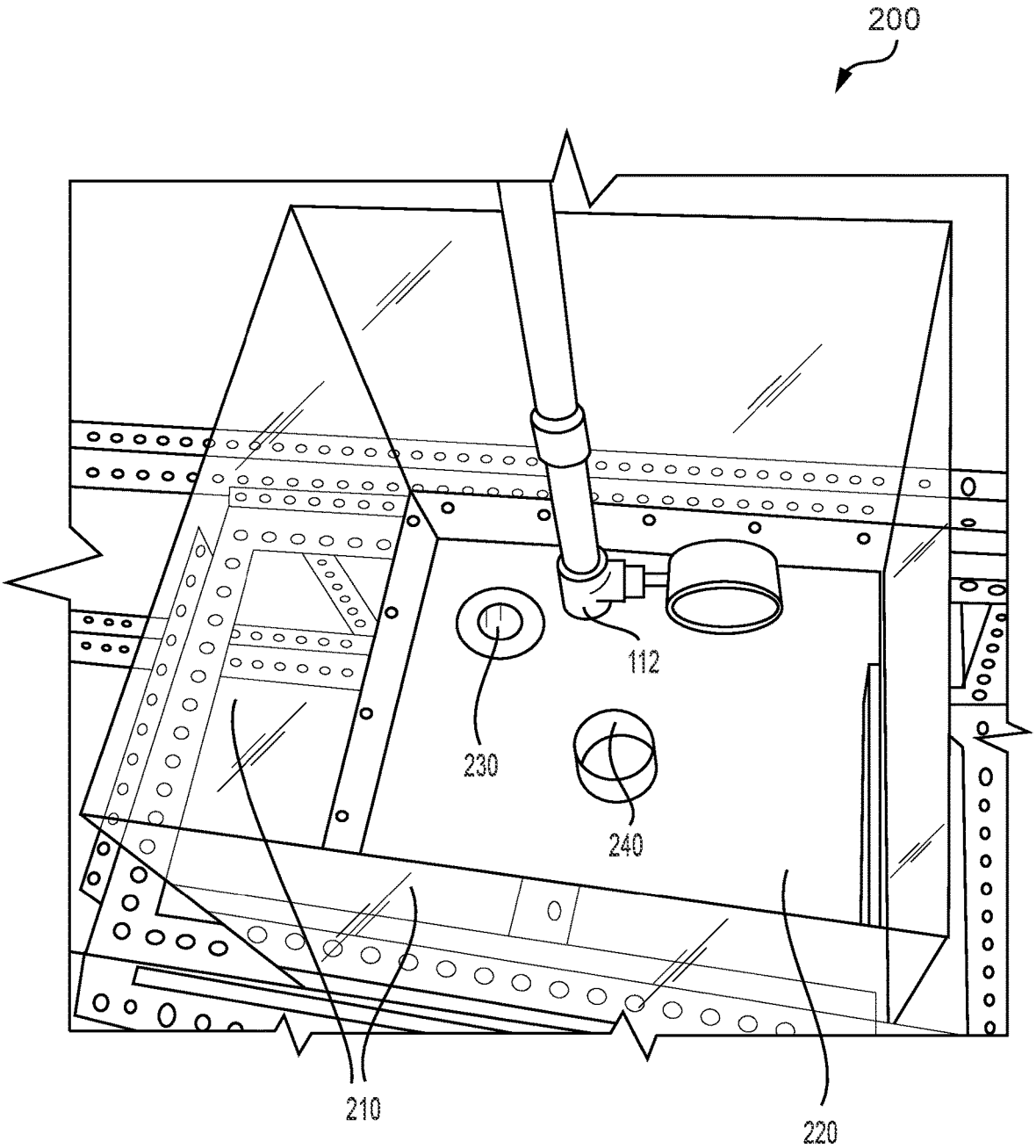
FIG. 2 is an illustration of a spray chamber.

FIG. 2 is an illustration of a spray chamber 200 that can enclose the workpiece receiving bed 110. The spray chamber 200 is made of stainless steel and polymer glass 210. The spray chamber base 220 has an outler 230 and cutout 240 in which a heater such as a bunson burner can be inserted for heating a workpiece. Nozzle 112 is fixed in the middle of the spray chamber 200.

Supply tank 102, in some embodiments, is a 50 gallon water storage tank having a capacity of 50 gallons. It can be equipped with 4 electrical heaters fixed at the bottom to control the temperature of the sprayed water. It also includes an outlet to pump, a bypass inlet, water level monitor and outlet valve to empty and clean the tank. The wall of the tank can be thermally insulated with fiber glass insulation and dually covered with a stainless steel sheet.

A stainless steel vertical centrifugal water pump can be used as the high pressure pump 106. It is a low noise, low corrosive liquid resistance compact structure having a small volume, light weight, easy to service and good seal performance. It can be used with liquids of low viscosity, neutral, non-explosive, chemically non-reactive with pump material and containing no solid particles and fibers. It is also suitable to work with non-corrosive nanoparticles dissolved in water.

In certain embodiments, the current spray cooling system can operate according to the following steps:

(a) Working conditions are set before the heating and cooling of the samples starts. In the case of a one phase spray cooling (Liquid), spray nozzles, which can be changed to vary the droplet size, mass flow rate of liquid, etc., can be installed one by one. Water flow rates can be adjusted with help of a bypass valve and Coriolis mass flow meter to a desired level and within the maximum capacity of the spray nozzle.

(b) In the case of multiphase phase spray cooling, the desired amount of nanoparticles are mixed with the liquid phase and the spray nozzles can be changed to those having a bigger orifice (if required).

(c) For the gaseous phase, an M series precision gas mass flow meter can be turned on to adjust the pressure and flow rate of the gas.

(d) The inlet water temperature can be adjusted by heating, if required. In one non-limiting example, water in the storage tank can be heated by one, two, three, four, five, or more heaters present in the storage tank.

(e) To acquire data from the temperature sensors, mass flow meters, and pressure sensors, a Data Acquisition/Switch Units can be turned on and connected to a computer.

(f) Target samples fitted with temperature sensors can be placed at the desired location(s) (spray chamber) in the spraying system heated up to the desire temperature and monitored on the computer.

(g) Once the desired temperature (for example, 600° C. to 1000° C.) of the sample is achieved, the water pump is turned on, and the spray valve is opened. In the case of a two-phase spray (water and gas), water and gas spray valves can be opened simultaneously.

(h) Inlet water, outlet water, gas, and sample temperature data can be recorded and saved as a csv file in the computer. Similarly, mass/volume flow rate data, inlet liquid and gas pressure data can be recorded with pressure sensors as well as manually with pressure gauges.

The mass flow meter 124, such as a Coriolis mass flow meter (ZLJ series), is used in the fluid delivery system to measure the mass flow rate of the fluid during a spraying process. Based on the principle of Coriolis force, the ZLJ series mass flow meter is a precision flow meter instrument, which has a special principle structure, advanced technical functions and is applied in a large number of fields. It provides comprehensive data, including mass flow, volume flow, density, temperature and reference parameters, makes reliable results without tedious conversion, and is a direct substitute for a voltmeter. It has high stability and no moving parts so there is no need for frequent maintenance. It has no choke-flow parts and a larger flow normal diameter which enables it to reduce pressure loss, energy consumption and improvidence.

Gas mass flow meter 136 in one embodiment is manufactured by Alicant Scientific. Its maximum flow rate capacity is 250 SLPM with maximum operating pressure of 145 psi. It has an accuracy of 0.8% (reading) and 0.2% (full scale). Its operational range is 0.5% to 100% of full scale with a repeatability of ±0.2%.

Supply line 114 and gas supply line 128 both are supplied with pressure transmitter BP-801 provided by HAIGE Company. Its measured pressure limit is 0-2.5 MPa with an accuracy of ±0.5%. A power of 24 VDC is needed to operate with an output signal of 4-20 mA. Its working fluid temperature range is −40~125° C.

The two pressure transmitters BP-801 are connected with a data acquisition system (data logger 138 and computer 140). The range of the measurement is 0-2.5 MPa, and the output signal is 4-20 mA, which is linear through the entire range of measurement. Due to the fact that the operating voltage is 24 VDC, voltage transformers are used to supply electricity.

In order to acquire data from temperature sensors, mass flow meters, and pressure sensors, an Agilent 34972A Data Acquisition/Switch Unit (data logger 138) is used, which is connected with the computer 140. It offers powerful measurement performance, flexibility, connectivity options and ease of use with three to five times lower cast than other data acquisition systems. It is provided with built-in Gigabit LAN and USB 2.0. Data can be logged directly to the USB flash drive to increase the memory of the instrument or copied from internal memory for transfer to a computer in another location. It is also provided with a LAN connection to get the benefit of graphical Web interface monitoring of results using a standard Web browser. Software, such as BenchLink Data Logger, is matched to the Agilent to control the Agilent and adjust the measuring parameters. Data is also recorded into an Excel data sheet.

Fluid streams are disbursed inside the spray chamber 200 which is maintained at atmospheric pressure. It is made of stainless steel and polymer glass. The bottom of the spray chamber has two holes, one serving as an outlet for sprayed water while the other is used to insert a Bunsen burner to heat up the stainless steel sample. A spray nozzle (nozzle 112) is fixed in the middle of the spray chamber 200. The dimensions, design and material of the spray chamber 200 can be changed as per working conditions and requirements.

Thermocouples are used to measure the temperature inside the test samples, which is the most important data for this experiment, therefore thermocouples with high accuracy are required in this task. Due to the dimensions of the probe holes in the test samples, K-type thermocouples modeled WRNK-191 from YISITE (Xinghua) Electric Factory (FIG. 8) are used. The diameter of the thermocouples is 1.5 mm, and the length is 100 mm. The range of detect temperature is 0-1100° C., which meets the needs of this experiment. Thermocouples are connected to a circuit board module inside the DAS Agilent 34972A, and the output signal is VDC, and the Agilent will convert the voltage signal into temperature. Moreover, there are also two thermocouples to measure the temperature of the water in the water tank and the temperature of the room.

A variety of different types of nozzles (nozzle 112) are used according to needs. A wide range of full cone spray nozzles are available from different manufacturers to be used in multiphase spray cooling system according to requirements. Axial whirl, full cone tangential whirl, full cone spiral nozzles and full cone air atomizing nozzles are some examples.

One-phase/Two phase (nanoparticles) spray nozzles, Model: B1/2GG-SS16, Model: B1/2GGANV-SS32 and Model: B1/2GGANV-SS32 are some recommendations according to specific use of multiphase spray cooling system.

Air atomizing nozzles Model: B1/4J-SS+SU22-SS (internal mix) (FIG. 12) and Model: B1/4J-SS+SU-HTE91A-SS are some further recommendations according to specific use of multiphase spray cooling system. The nozzle B1/4J-SS+SU22-SS has Fluid Cap 60100 and Air Cap 1401110. The nozzle B1/4J-SS+SU-HTE91A-SS has Fluid Cap PF2850 and Air Cap LP60650-60.

When using a pressure-fed liquid system, the liquid is supplied to the nozzle under pressure. The liquid and compressed air or gas are mixed internally to produce a completely atomized spray.

During full cone spray cooling working conditions (temperature, pressure, amount of liquid/gas/nano particles being supplied, timing etc.) are varied. The variation in condition depends on the specific use of the utility.

Temperature of Hot samples: 600° C. to 1000° C.

Temperature of liquid: 25° C. to 80° C. (Liquid with or without Nanoparticles e.g. copper nanoparticles (CuNPs), Al nanoparticle (AlNPs)

Spray time: 1 minutes to 3 minutes (in case of air atomized spray cooling time may reach to 5 minuses)

Cooling time depends upon size, thickness, material, initial temperature of sample and spray conditions such as flow rate, pressure, atomization etc.

Prior to conducting spray quenching of the cylindrical sample, two K type thermocouples (T1 and T2) are installed in each block. The error in thermocouple reading is +0.5° C. as provided by the manufacturer. Mass flow rate and inlet nozzle pressure are fix to a desired value with the help of a bypass value and monitored by a pressure sensor (0-2.5 MPa) with an accuracy of 0.5% of its full scale value and Coriolis mass flow meter (0.01-2.5 t/h) with an accuracy of 0.1% and 0.16% respectively. Data acquisition system, Agilent is used to record the temperature, pressure and mass flow experimental data.

After heating the stainless steel sample to a desire high temperature, the water pump is turned on, the by-pass valve is kept open and the spray valve is closed before beginning to spray the hot target surface. Once the temperature of the sample is dropped to the required high temperature, the spray valve (in the case of full cone nozzle, the water valve is open; and in the case of air atomized nozzle both water and gas valves are opened simultaneously). Cooling histories are recorded online with the help of data logger. Variation of mass flow rate, mean impinging velocity $u_o$, spray velocity at nozzle exit $u_j$, mean volume diameter (MVD), Sauter mean diameter (SMD), and Weber number $W_e$, with inlet pressure, are summarized in the below table.

Summary of variation of Mass Flow Rate, MVD, SMD, uo, uj and We with inlet nozzle pressure undergarments

| Pressure (MPa) | Mass Flow Rate (kg/min) | MVD (μm) | SMD (μm) | $u_o$ (m/s) | $u_j$ (m/s) | $W_e$ ($\times 10^3$) |
|---|---|---|---|---|---|---|
| 0.4 | 13.5 | 819.37 | 655.50 | 37.4 | 28.3 | 11.722 |
| 0.7 | 17.3 | 633.49 | 506.80 | 50.9 | 37.4 | 16.786 |
| 1.0 | 20.2 | 545.14 | 436.07 | 61.6 | 44.7 | 21.164 |
| 1.3 | 23.0 | 490.12 | 392.11 | 70.7 | 51.1 | 25.100 |

Details of Spray Conditions During Two-Phase Spray Cooling

All the conditions are subject to type of nozzle, type of pump, target flow rates and pressures.

Nozzle orifice diameter (mm)=1.5

Spray chamber pressure (MPa)=0.1

Spray chamber temperature (° C.)=25±2

Degree of subcooling ΔT (° C.)=23.5

Gas flow rate (kg/min)=0.05

Gas pressure (MPa))=0.1

Water mass flow rate (kg/min)=3.8

Total mass flux (kg/mm$^2$ s)=0.035

Water pressure (MPa)=0.4

Pressure drop at nozzle exit ΔP (MPa)=0.1

Mixture temperature at nozzle exit (° C.)=23.5

Nozzle exit velocity of water-gas mixture (m/sec)=0.2

Water-gas mixture density (kg/m$^3$)=84.8

Water-gas mixture viscosity (kg/m s)=$2.47\times10^{-5}$

Reynolds number of water-gas mixture at nozzle exit ($Re_m$)=1030

Aerodynamic Weber Number of water-gas mixture at nozzle exit ($We_m$)=0.07

| | | Condition I | Condition II | Condition III |
|---|---|---|---|---|
| Data from Agilent 34972A Data Acquisition | Water Pressure (MPa) | 0.089 | 0.852 | 1.844 |
| | Gas Pressure (MPa) | 0.138 | 0.125 | 0.175 |
| | Water Mass Flow | 1.035 | 1.257 | 1.380 |

-continued

| | | Condition I | Condition II | Condition III |
|---|---|---|---|---|
| System | (t/h) | | | |
| | Water Tank Temperature (° C.) | 25.338 | 25.514 | 25.923 |
| | Room Temperature (° C.) | 16.674 | 17.369 | 20.287 |
| Data from Alicat Mass Flow Meter | Gas Pressure (MPa) | 0.141 | 0.231 | 0.288 |
| | Gas Temperature (° C.) | 21.746 | 22.888 | 24.548 |
| | Gas Mass Flow (SLPM) | 41.458 | 56.624 | 73.741 |

The following is the operating process for the high pressure, high temperature spray cooling system as described above.

The water level in the water tank is initially checked to ensure that the water level is up to at least ½ of the capacity. The temperature of water in the water tank should be in the proximity of 25° C.

The regulating (spray control) valve in the liquid supply and bypass valve are adjusted to obtain the proper mass flow rate and pressure of the liquid spray.

In the case of liquid and gas phase, the regulating valve on the liquid supply side and the reducing valve on the gas supply side are operated to adjust the spray parameters of water and nitrogen to reach the designed value.

A test sample block is fixed on the test heated module, the support structure, two thermocouples, and the 1,300° C. high temperature resistant repair glue.

The test heated module is placed just below the nozzle. The spray is tested and the position of the heated module adjusted to ensure the footprint of the spray just covers the test surface. A coal gas heater is placed under the hole in the support structure to heat the test sample.

The BenchLink Data Logger is started to begin measurements. The coal gas supply is opened and the heater is lit to heat the test module. A heat insulation asbestos is used to cover the heated surface to prevent heat loss.

When both the temperatures read from the BenchLink Data Logger exceed the project value, the measurement of the BenchLink Data Logger are stopped and the memory is cleared. Both measurements of BenchLink Data Logger and Flow Vision are then initiated.

The water pump is turned on, the coal gas heater is turned off, the heat insulation asbestos is removed, and the valves both for water and nitrogen supply sides are opened to initiate spray cooling.

When the temperatures of both thermocouples read from the BenchLink Data Logger are lower than 50° C., both valves for the water and nitrogen supply sides are turned off to stop spray cooling.

The water pump is turned off and the measurements from the BenchLink Data Logger and Flow Vision are stopped and saved as data in the computer.

Figure 3:
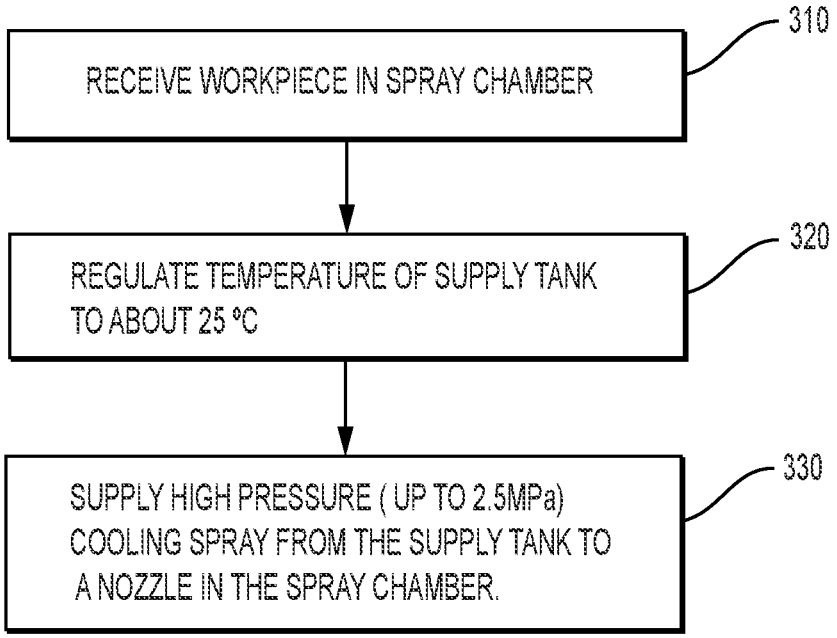
FIG. 3 is a flow diagram showing the steps of operating a high pressure, high temperature spray cooling system.

FIG. 3 is a flow diagram showing the steps of operating a high pressure, high temperature spray cooling systems as described above.

A workpiece is received in a spray chamber having a workpiece receiving bed and a nozzle spaced apart from the workpiece receiving bed in step 310, The temperature of a supply tank is regulated to a set temperature in step 320. The supply tank includes a heater, and a high pressure pump is connected to the nozzle by a supply line In step 330 a high pressure cooling spray is supplied through the nozzle in the spray chamber from the supply tank.

The pressure in the supply line can be adjusted using a control valve and a bypass valve.

A gas can also be supplied though the nozzle from a gas supply tank having a first gas line end connected to the gas supply tank and a second gas line end connected to the nozzle.

The pressure in the gas line can further be adjusted using a gas regulating valve.

The gas being supplied is nitrogen gas in some embodiments.

The high pressure cooling spray can include water and nano-particles.

The nano-particles, in some embodiments, are copper nano-particles (CuNPs) or aluminum nano-particles (AlNPs).

A pressure of up to 2.5 MPa can be applied to the supply line in some embodiments.

It is to be understood that high pressure, high temperature spray cooling for heat transfer and ultra-fast cooling is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A high pressure, high temperature spray cooling system for heat transfer, the system comprising:

a supply tank having a heater and a high pressure pump;

a spray chamber spaced apart from the supply tank, the spray chamber having a workpiece receiving bed and a nozzle spaced apart from the workpiece receiving bed;

a supply line having a first supply line end and a second supply line end, the first supply line end connected to the supply tank and the second supply line end connected to the nozzle such that contents within the supply tank are supplied to the nozzle through the supply line at a high pressure to cool a workpiece on the workpiece receiving bed; and a gas supply tank, a gas line having a first gas line end connected to the gas supply tank and a second gas line end connected to the nozzle, wherein the gas supply tank contains nitrogen gas, wherein the supply tank contains a liquid and nano-particles, wherein the liquid is water, the nano-particles are copper nano-particles (CuNPs) or aluminum nano-particles (AlNPs), and the nano-particles are mixed in the liquid to form a homogenous suspension, and wherein the workpiece is heated to a temperature of 600° C. to 1,100° C. and the high pressure pump that reaches pressures of up to 2.5 MPa.

2. The system as recited in claim 1 wherein the supply line further comprises a control valve and a bypass valve to adjust the pressure of the contents in the supply line.

3. The system as recited in claim 2 further comprising a mass flow meter located between the first supply line end and the second supply line end.

4. The system as recited in claim 1 further comprising a gas regulating valve to adjust the pressure of the gas supply in the gas line.

5. The system as recited in claim 4 further comprising a gas flow meter located between the first gas supply end and the second gas supply end.

6. The system as recited in claim 1 further comprising a controller that acquires temperature data and pressure data in the system and adjusts the system to specific temperatures and pressures.

7. A high pressure, high temperature spray cooling method for heat transfer, the method comprising:

receiving a workpiece in a spray chamber having a workpiece receiving bed and a nozzle spaced apart from the workpiece receiving bed;

regulating the temperature of a supply tank to a set temperature, the supply tank having a heater and high pressure pump and being connected to the nozzle by a supply line; and supplying a high pressure cooling spray through the nozzle in the spray chamber from the supply tank.

8. The method as recited in claim 7 further comprising adjusting the pressure in the supply line using a control valve and a bypass valve.

9. The method as recited in claim 7 further comprising supplying a gas to the nozzle from a gas supply tank having a first gas line end connected to the gas supply tank and a second gas line end connected to the nozzle.

10. The method as recited in claim 7 further comprises adjusting the pressure in a gas line using a gas regulating valve.

11. The method as recited in claim 10 wherein the gas being supplied is nitrogen gas.

12. The method as recited in claim 7 wherein the high pressure cooling spray includes water and nano-particles.

13. The method as recited in claim 12 wherein the nano-particles are copper nano-particles (CuNPs) or aluminum nano-particles (AlNPs).

14. The method as recited in claim 7 further comprising applying a pressure of up to 2.5 MPa into the supply line.

* * * * *